US005475655A

United States Patent [19]

Kerr

[11] Patent Number: 5,475,655

[45] **Date of Patent: * Dec. 12, 1995**

[54] NAUTICAL CLOCK APPARATUS AND METHODS

[76] Inventor: Breene M. Kerr, P.O. Box 369, Royal Oak, Md. 21662

[ * ] Notice: The portion of the term of this patent subsequent to Dec. 14, 2010, has been disclaimed.

[21] Appl. No.: 110,293

[22] Filed: Aug. 20, 1993

Related U.S. Application Data

[63] Continuation-in-part of Ser. No. 594,650, Oct. 9, 1990, Pat. No. 5,086,417, and a continuation of Ser. No. 829,651, Feb. 3, 1992, Pat. No. 5,270,986.

[51] Int. Cl.[6] ..... G04B 19/26

[52] U.S. Cl. ..... 368/19

[58] Field of Search ..... 368/15–19

[56] References Cited

U.S. PATENT DOCUMENTS

| | | | |
|---|---|---|---|
| 245,130 | 8/1881 | Burmann . | |
| D. 317,028 | 8/1991 | Bourquin . | |
| D. 318,810 | 8/1991 | Bourquin . | |
| 463,101 | 11/1891 | Cory . | |
| 508,467 | 11/1893 | Clark . | |
| 1,126,214 | 1/1915 | Herschede . | |
| 1,997,511 | 4/1935 | Canepa | 58/58 |
| 2,437,621 | 3/1948 | Strate | 235/78 |
| 3,570,239 | 3/1971 | Charles . | |
| 3,703,804 | 11/1972 | Appelberg . | |
| 3,721,083 | 3/1973 | Jauch | 58/3 |
| 3,825,181 | 7/1974 | Banner | 235/88 |
| 3,902,309 | 9/1975 | Torrence | 58/3 |
| 3,921,383 | 11/1975 | Leone . | |
| 4,014,163 | 3/1977 | Wisser | 58/3 |
| 4,435,795 | 3/1984 | Frank | 368/16 |
| 4,623,259 | 11/1986 | Oberst | 368/19 |
| 4,659,232 | 4/1987 | Coster et al. | 368/223 |
| 4,684,260 | 8/1987 | Jackle | 368/16 |
| 4,692,031 | 9/1987 | Kaneko et al. | 368/18 |
| 4,759,002 | 7/1988 | Cash | 368/15 |
| 4,849,949 | 7/1989 | Voth | 368/19 |
| 4,853,908 | 8/1989 | Bourquin et al. | 368/19 |
| 4,993,002 | 2/1991 | Kerr | 368/19 |
| 5,086,417 | 2/1992 | Kerr | 368/19 |
| 5,111,439 | 5/1992 | Erard | 368/19 |
| 5,222,051 | 6/1993 | Dubois et al. | 368/19 |
| 5,270,986 | 12/1993 | Kerr | 368/19 |

FOREIGN PATENT DOCUMENTS

| | | |
|---|---|---|
| 37984 | 3/1909 | Austria . |
| 2944747 | 5/1981 | Germany . |
| 62-116287 | 5/1987 | Japan . |
| 62-263490 | 11/1987 | Japan . |
| 411143 | 9/1907 | Switzerland . |
| 281195 | 6/1952 | Switzerland . |

OTHER PUBLICATIONS

A brochure published by Krieger™ Watch Corp. entitled "It's High Time".

Article appearing in the Wall Street Journal entitled "New Wave of Watches Tells Tide and Time".

Advertisement/brochure entitled "Introducing . . . The Tide Watch™—A Unique Tide Forecaster with Graphic Display", published by Tidewatch Products, Inc.

A Jewelers Circular—Keystone (JC–K) (Pulsar Time), p. 87 (Mar., 1988).

P. Schureman, U.S. Department of Commerce, Manual of Harmonic Analysis and Prediction of Tides, Special Publication No. 98, pp. 126–129 & 308.

Waves, Tides and Shallow–Water Processes, p. 57.

*Primary Examiner*—Bernard Roskoski

*Attorney, Agent, or Firm*—Dougherty, Hessin, Beavers & Gilbert

[57] ABSTRACT

Improved nautical clock apparatus and methods are provided. The nautical clock apparatus is basically comprised of a clock base and a tide state indicator attached to the base. Means are attached to the tide state indicator and to the base for causing the indicator to indicate the tide state based on a time of about 12 hours and 25.235 minutes between high tides and a continuous correction to such time which lengthens and shortens such time on a cycle whereby it is longer during one or more portions of each lunar month and shorter during one or more other portions of each lunar month.

9 Claims, 7 Drawing Sheets

NAUTICAL CLOCK APPARATUS AND METHODS

This application is a continuation-in-part of Applicant's application Ser. No. 07/594,650 filed Oct. 9, 1990, now U.S. Pat. No. 5,086,417 and a continuation of Ser. No. 07/829,651 filed Feb. 3, 1992, now U.S. Pat. No. 5,270,986.

BACKGROUND OF THE INVENTION

1. Field of the Invention.

The present invention relates generally to improved nautical clock apparatus and methods, and more particularly, to improved nautical clock apparatus which, among other things, indicate states of tides and methods of improving such tide state indication.

2. Description of the Prior Art

Nautical clocks which continuously indicate the states of ocean tides have heretofore been developed and utilized. Such clocks can also indicate the phases of the moon and are usually combined with conventional time of day clocks.

Ocean tides are primarily caused by the gravitational forces exerted on the earth by the moon and the sun with the moon's gravitational force being dominate. Based on the 24 hour and 50.47 minute time in a lunar day, i.e., the average time between moon rise to moon rise on two consecutive nights, there is a high tide approximately every 12 hours and 25.235 minutes. A low tide typically follows every high tide by about 6 hours and 12.618 minutes.

Prior nautical clocks which have included tide state indicators have been based on the time interval of about 12 hours and 25 minutes between high tides. However, because of a variety of factors such as the relative locations of the moon and the sun with respect to the earth, the inclinations of the orbits of the sun and the moon with respect to the orbit of the earth and other celestial perturbations, the time between high tides varies continuously. As a result, nautical clocks utilized prior to the present invention have generally provided only rough indications of the times of high and low tides.

Thus, there is a need for an improved nautical clock for indicating the state of the tide which is more accurate than the clocks used heretofore. Also, there is a need for an improved nautical clock which accurately indicates the state of the tide and also indicates the phase of the moon and the time of day.

SUMMARY OF THE INVENTION

By the present invention, improved nautical clock apparatus and methods are provided which overcome the shortcomings of the prior art and meet the needs described above. An improved nautical clock apparatus of this invention is comprised of a clock base, a tide state indicator attached to the base, and means attached to the tide state indicator and to the base for causing the tide state indicator to continuously indicate the tide state based on a time of about 12 hours and 25.235 minutes between high tides and a continuous correction to such time which lengthens or shortens the time on a cycle whereby the time is varied during particular periods of the lunar month. For example the time can be longer during the first and third quarters of each lunar month and shorter during the second and fourth quarters of each lunar month. More specifically, the indicated time between high tides can be increased from 12 hours and 25.235 minutes to a maximum longer time and then decreased to 12 hours and 25.235 minutes during certain portions of each lunar month, and the time can be decreased from 12 hours and 25.235 minutes to a minimum shorter time and then increased to 12 hours and 25.235 minutes during other portions of each lunar month with the average time for the lunar month remaining the same (12 hours and 25.235 minutes) or changing very little. In a preferred nautical clock apparatus, the state of the tide, the time of day and the phase of the moon including the number of days before or after a particular moon phase are all indicated.

A mechanical or electro-mechanical nautical clock of this invention is comprised of a clock base and a rotatable tide state indicator attached to the base. A drive means is attached to the base and to the tide state indicator for rotating the indicator at a rate of about one revolution every 12 hours and 25.235 minutes, and a movable marker is attached to the base for marking a position of the tide state indicator which represents the state of the tide. Means for moving the marker are attached thereto and to the base whereby the tide state indicator and marker indicate a time of high tide which is less, equal to or more than 12 hours and 25.235 minutes since the preceding time of high tide.

The methods of the present invention for improving the indication of the state of the tide in a nautical clock are comprised of basing like tide states on a time therebetween of about 12 hours and 25.235 minutes and a continuous correction to such time to account for celestial body perturbations which lengthens and shortens the time on a cycle whereby the time is varied, but the average time between like tide states over the lunar month remains at 12 hours and 25.235 minutes or changes only by a limited or predictable amount.

It is, therefore, a general object of the present invention to provide improved nautical clock apparatus and methods.

Other and further objects, features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIG. 9 is a front view of the nautical clock apparatus when the alternate correcting means illustrated in FIG. 8 are used.

DESCRIPTION OF PREFERRED EMBODIMENTS

Figure 1:
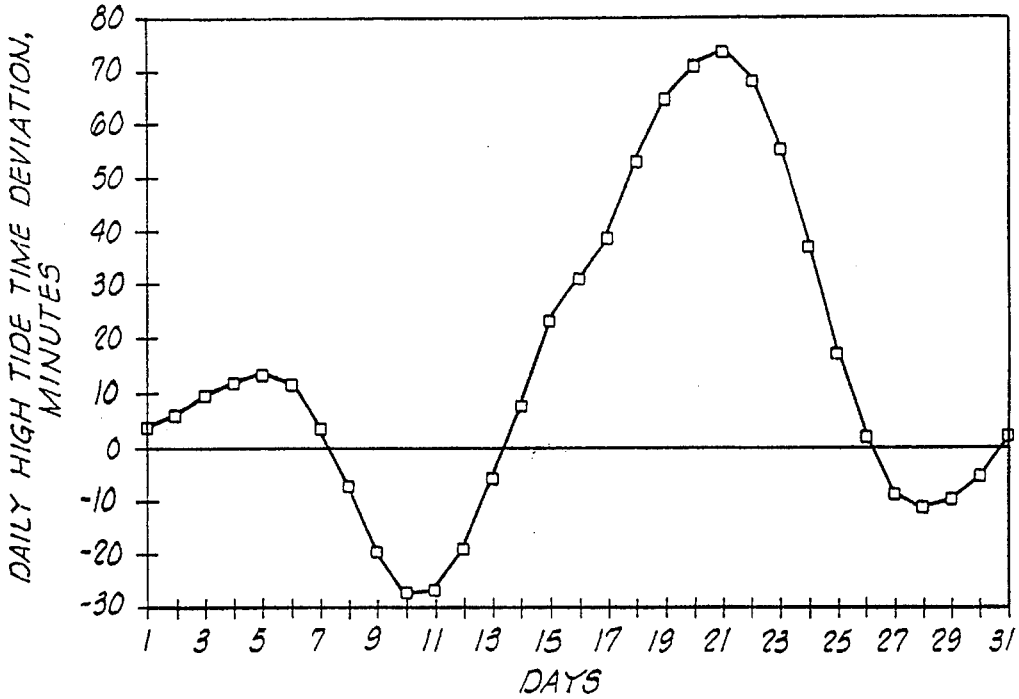
FIG. 1 is a graph showing the deviation of the actual daily high tide time from the 24 hour and 50.47 minute lunar cycle at a particular location during a particular lunar month.

The improved nautical clock apparatus of the present invention can take a variety of forms. That is, the clock can indicate the state of the tide only, or it can be combined with a time clock which indicates the time of day. In addition, the clock can include a moon phase indicator. The term "state of the tide" is used herein to mean whether the tide is at its high state, its low state, the flooding state between low tide and high tide, or the ebbing state between high tide and low tide. The term "daily high tide time" is used herein to mean the average time between daily high tides, i.e., from high tide at a particular time of day to high tide at the same time of the next day. Such daily high tide time is 24 hours and 50.47 minutes.

During each day there are two high tides and two low tides with ebbing (decreasing) and rising (increasing) inbetween. The average time interval between two successive like tide states, e.g., high tides, is 12 hours and 25.235 minutes. However, as will be described in detail hereinbelow, the time intervals between high tides vary considerably from day to day, month to month and year to year as a result of moon, sun and other celestial body perturbations. The term "moon phase" is used herein to mean the phase of the moon as it changes during each lunar month between new moon, waxing moon, full moon, waning moon and back to new moon.

The nautical clock apparatus can be purely mechanical, i.e., driven by one or more spring drives and including gears, rotating disks, hands and the like; electro-mechanical wherein one or more electric motors are substituted for the spring drive or drives; or electronic including electronic readout devices, electric drives, time computers, etc. In whatever form the nautical clock apparatus takes, it is basically comprised of a clock base having a tide state indicator attached thereto. Mechanical, electro-mechanical or electronic means are attached to the tide state indicator and to the base for causing the tide state indicator to continuously indicate the tide state based on a time of about 12 hours and 25.235 minutes between successive like tide states and a continuous correction to such time to account for celestial body perturbations. More specifically, the continuous correction to the basic time of 12 hours and 25.235 minutes between successive like tide states lengthens and shortens the time on a cycle whereby the time is longer during certain portions of each lunar month and shorter during other portions of each lunar month.

As will be described in greater detail hereinbelow, the continuous correction cycle can increase the time between successive like tide states from 12 hours and 25.235 minutes to a maximum longer time and then decrease the time to 12 hours and 25.235 minutes during certain portions of each lunar month, and decrease the time from 12 hours and 25.235 minutes to a minimum shorter time and then increase the time back to 12 hours and 25.235 minutes during other portions of each lunar month. In addition and as will be described below, the correction cycle is periodically modified to conform the tide state indication to changes in the actual tide state brought about by the ongoing and changing celestial perturbations.

The nautical clock, in addition to indicating the state of the tide, also preferably includes a time clock for indicating the time of day. In a most preferred embodiment, the nautical clock also includes means for indicating the various phases of the moon during each lunar month. The moon phase indication facilities setting and checking the tide state indicator.

Figure 2:
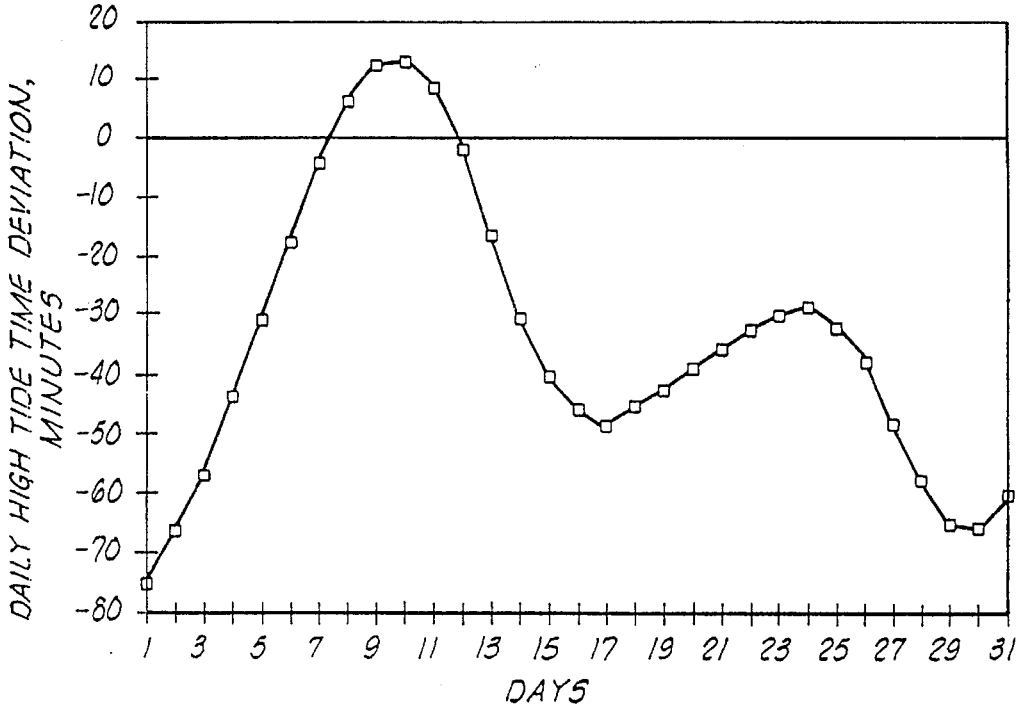
FIG. 2 is a graph similar to FIG. 1 showing the deviation of the actual daily high tide time from the 24 hour and 50.47 minute lunar cycle at the same location and for the same lunar month, but in a different year.
Figure 3:
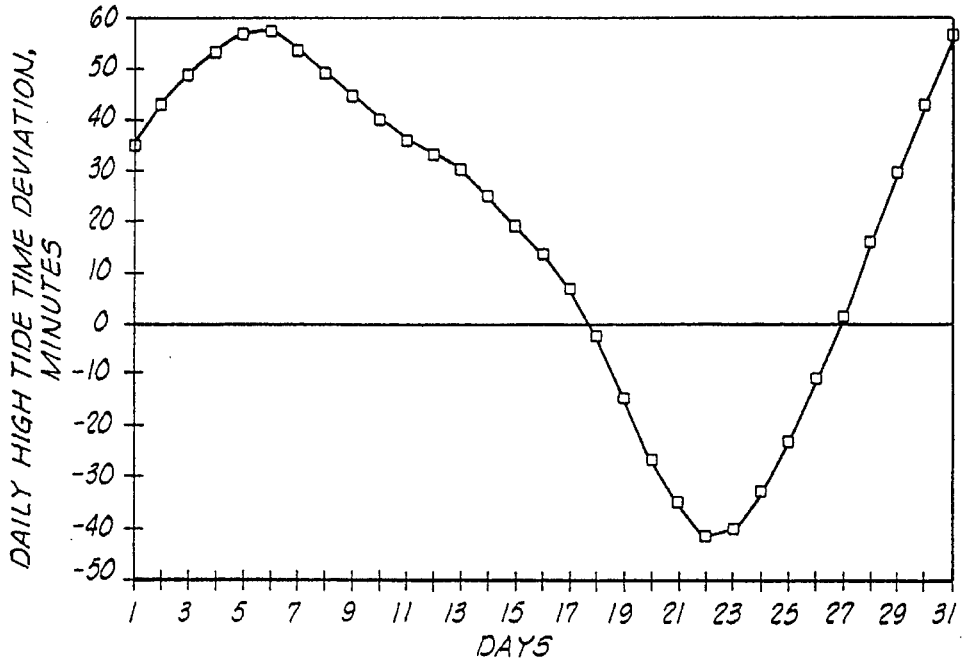
FIG. 3 is a, graph similar to FIG. 1 showing the deviation of the actual daily high tide time from the 24 hour and 50.47 minute lunar cycle at the same location and in the same year, but for a different lunar month.

Referring now to the drawings, and particularly to FIGS. 1–4, various graphs are presented which illustrate examples of the deviations from the average time between successive like tide states which take place. FIG. 1 shows the actual deviations in daily high tide time during the third lunar month of 1987 at Boston, Mass. The new moon occurred on Feb. 27, 1987; the full moon occurred on Mar. 15, 1987; and the succeeding new moon occurred on Mar. 29, 1987. FIG. 2 is a graph similar to FIG. 1, but showing the actual deviations at Boston during the third lunar month in 1992, during which the new moon occurred on Mar. 4, 1992. FIG. 3 is yet another graph similar to FIG. 1, but showing the actual daily high tide time deviations at Boston during the sixth lunar month in 1987, approximately coinciding with July of that year. In the graphs of FIGS. 1–3, the data points above the zero line are days when the daily high tide time was longer than the average time of 24 hours and 50.47 minutes, and the data points below the zero line are the days when the daily high tide time was shorter than the average. The graphs of FIGS. 1–3 illustrate the fact that the daily high tide time (and also the time between successive like tide states) can be longer during certain portions of each lunar month and shorter during other portions of each lunar month. The graphs of FIGS. 1–3 also show that the times by which the average daily high tide time is lengthened or shortened varies from day to day, month to month and year to year.

In accordance with the present invention a harmonic correction is applied to the average time between successive like tide states, i.e., 12 hours and 25.235 minutes, each lunar month. The harmonic correction can be comprised of two correction components, one of which can be called the Solunar correction as it introduces a correction to take into account the alternate lengthening and shortening of the time between like tide states because of changes in the spatial relationship of the sun and the moon during the four quarters of the lunar month. The other correction component can be called the Anomalistic correction as it takes into account the eccentricity of the lunar orbit during the anomalistic month. The eccentricity of the lunar orbit results in a variation in the moon's distance from the earth which changes the time between like tides. Both corrections follow sine curve paths during each lunar month, but have different periods. The period of the Solunar correction is one half of a lunar month while the period of the Anomalistic correction is nearly equal to a lunar month. That is the Anomalistic correction period is 27.55 days and the lunar month is 28.53 days.

Figure 4:
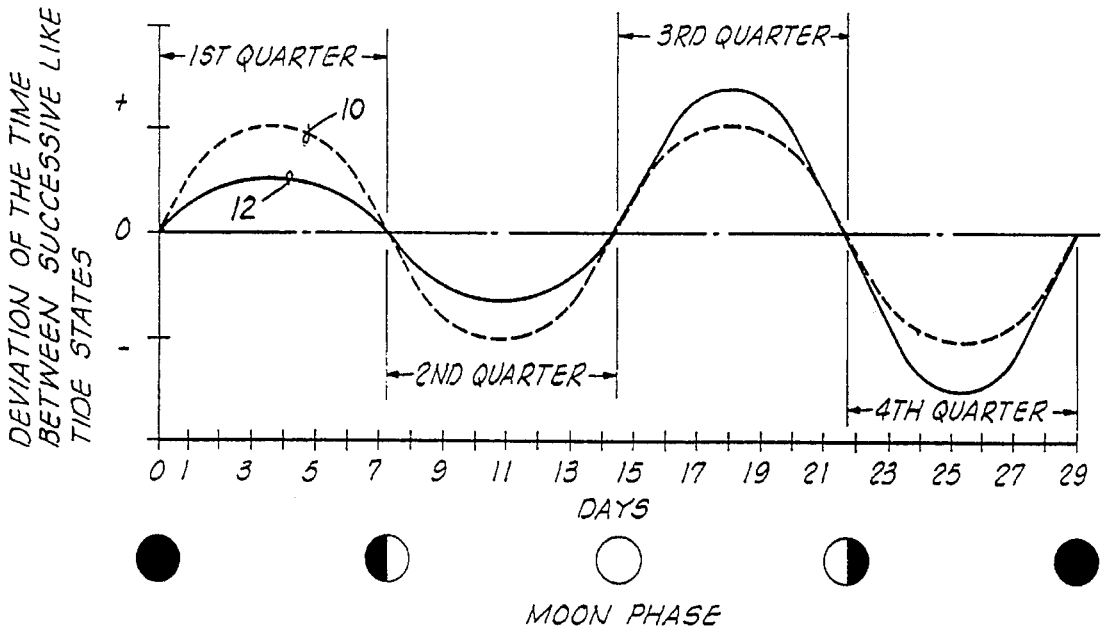
FIG. 4 is a graph illustrating an example of corrections which can be applied to the time between successive like tide states in accordance with the present invention.
Figure 4A:
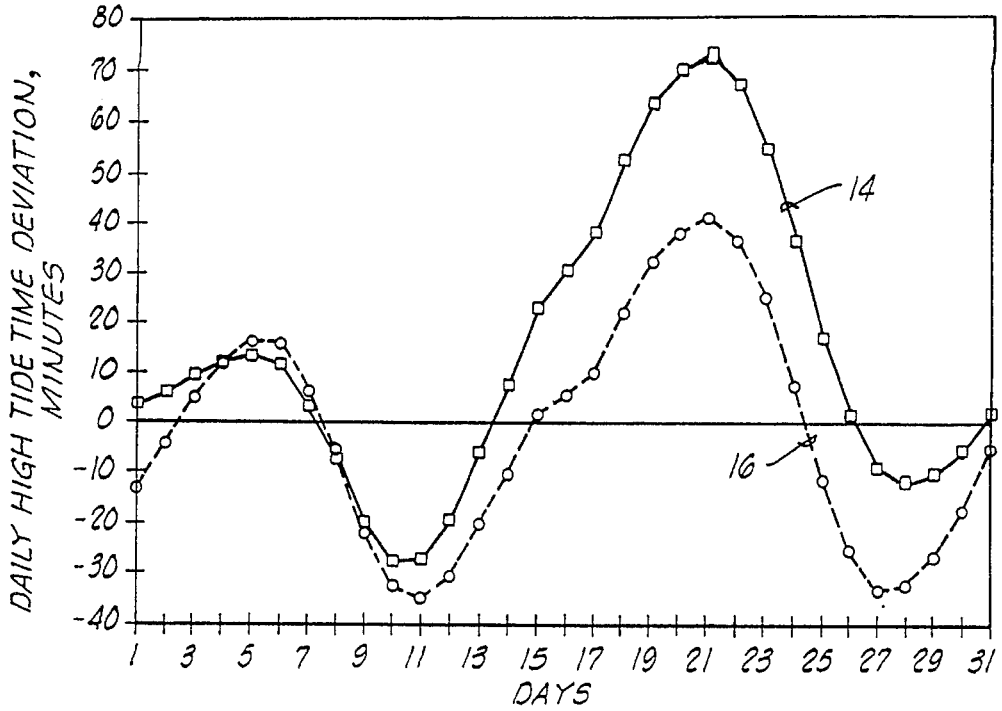
FIG. 4A is a graph in which the deviation of the actual daily high tide time from the lunar cycle at a particular location during a particular lunar month is compared with the deviation from the lunar cycle for the same location and time as predicted in accordance with a harmonic correction of the present invention.
Figure 4B:
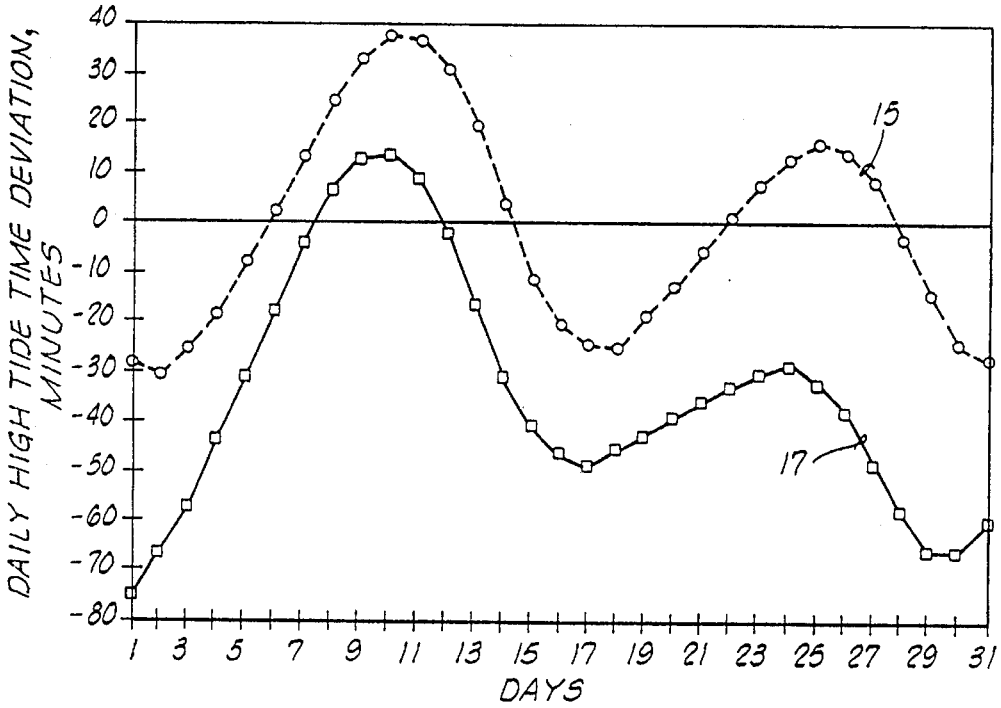
FIG. 4B is a graph like FIG. 4A for the same lunar month but during a different year.

An example of the result of applying the Anomalistic correction is shown in FIGS. 4A and 4B. The data curve lines generally follow the path of double sinusoidal curves. The Anomalistic correction changes the data curve so that the resulting corrected curve follows a more uniform path which more closely resembles a true sine curve of deviations in the time between successive like tide states.

The amplitudes of the oscillations during the first and second lunar quarters are reduced or increased and the amplitudes of the oscillations during the third and fourth quarters are increased or decreased. As indicated above, however, the phase relationship of the correction components which produce the resulting harmonic correction must be periodically changed in order to produce the corrected deviation in the time between like tide states. The changes can cause the increases or decreases in the time between like tide states to occur quite differently from those illustrated by the data curves in FIGS. 4A and 4B. When periodic changes to the phase relationship of the correction components producing the harmonic corrections are made, the resulting correction produces times which more closely approximate the actual times resulting from the sun-moon-earth perturbations and other celestial body influences.

More specifically, referring now to FIG. 4A, the data curve line representing the actual deviation in daily high tide illustrated in FIG. 1 (the deviation during the third lunar month of 1987 at Boston, Mass.) is shown and designated by the numeral 14. For comparison purposes, a second data curve line 16 is set forth which represents the deviation in daily high tide time for the same location and time predicted by applying only the Anomalistic correction component in accordance with the present invention. In FIG. 4B, the data curve line from FIG. 2 (actual deviation in daily high tide time during the third lunar month of 1992 at Boston) designated by the numeral 17 is compared with a data curve line 15 which is the deviation for the same location and time as predicted by applying only the Anomalistic correction component. It can clearly be seen from FIGS. 4A and 4B that a significant improvement in predicting the times between successive like tide states is provided by the present invention utilizing the Anomalistic correction component. The Solunar correction curve is a fairly regular double sine curve. A significant further improvement results when the Solunar correction component is utilized in a manner similar to that described herein.

Figure 5:
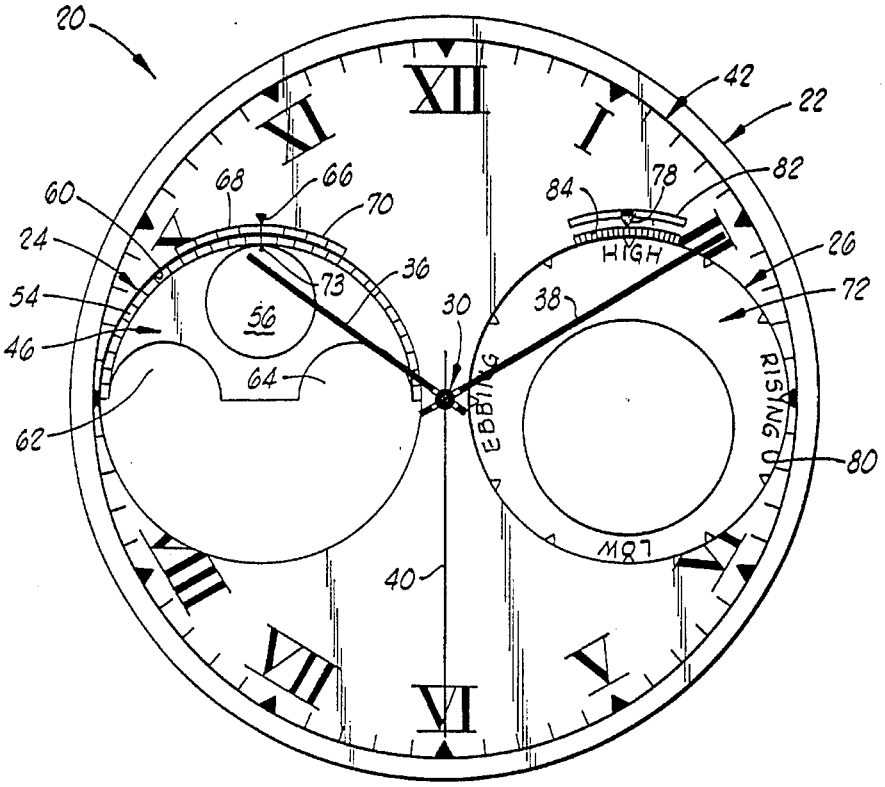
FIG. 5 is a front view of one form of nautical clock apparatus of the present invention.
Figure 6:
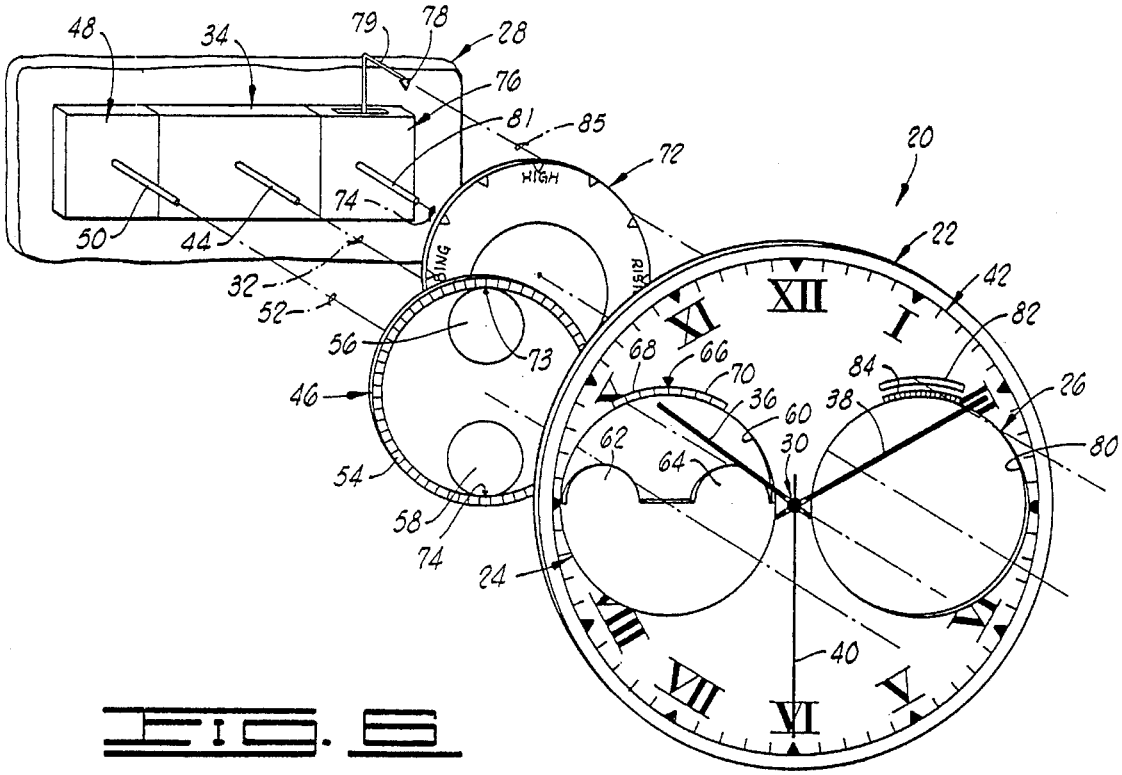
FIG. 6 is an exploded view of the nautical clock apparatus of FIG. 5.

Referring now to FIGS. 5 and 6, one form of the improved nautical clock apparatus of the present invention is illustrated and generally designated by the numeral 20. The clock 20 comprises a conventional daily time clock 22, a moon phase indicator 24 and tide state indicator 26. As best shown in FIG. 6, the daily time clock 22 is comprised of a base 28 and hour, minute and second hand means 30 attached to the base 28 and rotatable about a central axis 32 extending from the base 28. Drive means 34 are attached to the base 28 for rotating the hour, minute and second hand means 30 whereby the hour hand 36, the minute hand 38 and the second hand 40 thereof are rotated on hour, minute and second rates, respectively. The time clock 22 includes a face 42 attached to the base 28 which includes the usual hour, minute and second markings thereon.

The drive means 34 of the time clock 22 can take a variety of forms as mentioned above, but in the embodiment illustrated in the drawing it includes a multiple component drive shaft 44 extending from conventional gear and timing mechanisms which are driven by a spring or electric motor (not shown). The drive shaft 44 is connected to the clock hand means 30 so that the hour, minute and second hands rotate individually at their respective rates. As will be understood by those skilled in the art, the base 28 can be the housing or part of the housing of a self standing clock or it can be adapted for mounting in a surface such as the instrument panel of a boat. As will be further understood, The phrase "attached to the base" and other similar phrases used herein mean that the part or component referred to is directly or indirectly attached to the base either rotatably or fixedly.

The moon face indicator 24 is comprised of a moon disk 46 attached to drive means 48 by a shaft 50 whereby the moon disk 46 is rotatable about a central axis 52. The face of the moon disk 46 includes a continuous graduated scale 54 positioned around the periphery thereof, and a pair of moon representations 56 and 58 are positioned 180° apart adjacent the scale 54. The scale 54 includes a plurality of equally spaced divisions, each of which represents one 24 hour solar day of a lunar month. The moon representations 56 and 58 are images of full moons which can be painted on the disk 46 or attached thereto. The drive means 48 can take various forms, but when the moon indicator 26 is combined with a time clock, the drive means 48 is usually a geared takeoff from the time clock drive motor. The drive means 48 rotates the moon disk 46 at a rate of one-half of a revolution (180°) over the 29.53 day lunar month which represents a single lunar orbit.

The moon disk 46 is positioned behind the clock face 42, and the clock face 42 includes an opening 60 therein which shields the rotating moon disk 46 whereby only one moon image 56 or 58 can be seen at a time. The opening 60 can take various forms, but it preferably is crescent-shaped and includes two equally spaced semicircular projections 62 and 64. The projections 62 and 64 are of diameters equal to or slightly larger that the diameters of the moon representations 56 and 58 on the disk 46. The curvilinear top of the opening 60 is of a size such that approximately 28½ divisions of the scale 54 are visible. The circular projections 62 and 64 of the clock face 42 shield appropriate portions of each of the moon images 54 and 56 as they move across the opening 60. Thus, the lunar cycle begins when one of the moon images 54 or 56 is behind the projection 62 (new moon) and as the moon disk 46 rotates clockwise, the moon image moves out from behind the projection 62 whereby more and more of the moon image is visible (waxing moon). When the moon image is fully exposed, a full moon is indicated, and as the moon image passes beneath the projection 64 (waning moon) and disappears completely (new moon) a lunar cycle is complete. A marker 66 is provided on the clock face 42 which indicates the center point of the curvilinear top of the opening 60, and when one of the center point markers 72 or 74 of the moon images 56 or 58 is positioned adjacent to the marker 66, a full moon is indicated.

A pair of vernier scales 68 and 70 are positioned on either side of the marker 66. The number of divisions of the scale 54 on the moon disk 46 in the counterclockwise direction from the pointer 66 to the center point 72 or 74 of the closest moon image 56 or 58 indicates the number of days before the full moon will occur. Conversely, the number of the divisions 54 in a clockwise direction from the pointer 66 to the center point 72 or 74 of the closest moon image 56 or 58 indicates the number of days since the full moon has occurred. The vernier scales 68 and 70 allow the time before the full moon occurs or the time after the full moon has occurred to be determined more precisely by indicating fractions of a day. The vernier scales and their use are described in greater detail in my U.S. Pat. No. 4,993,002 issued on Feb. 12, 1991, which is incorporated herein by reference.

The moon phase indicator 24 of the nautical clock 20 is set in accordance with the time before or after the next or last full moon. Such time can be determined from a source such as a Gregorian calendar or a daily newspaper, The moon face indicator will thereafter provide an indication of the face of the moon and the time before the next full moon will occur or after the last full moon has occurred to the nearest fraction of a day.

Referring still to FIGS. 5 and 6, the tide state indicator 26 is comprised of a tide disk 72 attached to the base 28 which is rotatable about a central axis 74. The disk 72 includes markings on the face thereof which indicate high tide, low tide, rising and ebbing. The tide disk 72 is connected to a drive means 76 by a shaft 81 which rotates the tide disk in a clockwise direction at a rate of about one revolution every 12 hours and 25.235 minutes. A movable marker 78 which is attached to the drive means 76 by an arm member 79 marks a position of the tide disk 72 which represents the state of the tide at that moment.

As will be described in greater detail hereinbelow, the drive means 76, in addition to rotating the tide disk 72 as described above, moves the marker 78 whereby it and the tide disk 72 indicate a time of a tide state which is less, equal to or more than twelve hours and 25.235 minutes since the preceding like tide state. More specifically, and as shown in FIG. 4, the drive means 76 continuously reciprocates the marker 78 by means of the arm member 79 between a preselected high tide time which is longer than 12 hours and 25.235 minutes and a preselected high time tide which is shorter than 12 hours and 25.235 minutes at least once during each lunar month. Thus, as described previously, the drive means 76 rotates the tide disk 72 and moves the marker 78 whereby the time between high tides throughout each lunar month increases from 12 hours and 25.235 minutes to a maximum longer time and then decreases back to 12 hours and 25.235 minutes during certain portions of each lunar month, and decreases from 12 hours and 25.235 minutes to a minimum shorter time and then increases back to 12 hours and 25.235 minutes during other portions of each lunar month with the average time between successive like tide states remaining at 12 hours and 25.235 minutes or very close thereto.

A circular opening 80 is provided in the clock face 42 having a diameter which is substantially equal to the diameter of the tide disk 72, and the tide disk 72 is positioned whereby the face of the tide disk is visible through the opening 80. The clock face 42 also includes an arcuate slot positioned above the circular opening 80 through which the arm 79 connecting the marker 78 to the drive means 76 extends. That is, the horizontal portion of the arm 79 is positioned on a line 84 which aligns with the slot 82. As the arm 79 is moved back and forth in counterclockwise and clockwise directions, the pointer 78 connected to the arm 79 indicates the state of the tide marked on the face of the tide disk 72. A graduated scale 84 is included on the clock face 42 adjacent the opening 80 immediately below the slot 82.

The tide state indicator 26 is set according to the state of the tide at the time. Various sources are available for determining the exact times of each tide for a particular location. For example, if it is determined that high tide will occur at 10:10:30 a.m. on the first day of a lunar month, the tide state indicator is set as shown in FIG. 5 whereby the marker 78 is in alignment with the high tide representation on the face of the tide disk 72, and the marker 78 is at the midpoint of its left and right travel. The drive means 76 are simultaneously set to begin the movement of the marker 78 through the cycle which in combination with the tide representations on the face of the tide disk 72 indicate the state of the tide as described above throughout the lunar month. Once set, the tide state indicator 26 continuously provides an indication of the state of the tide at any given time.

Figure 7:
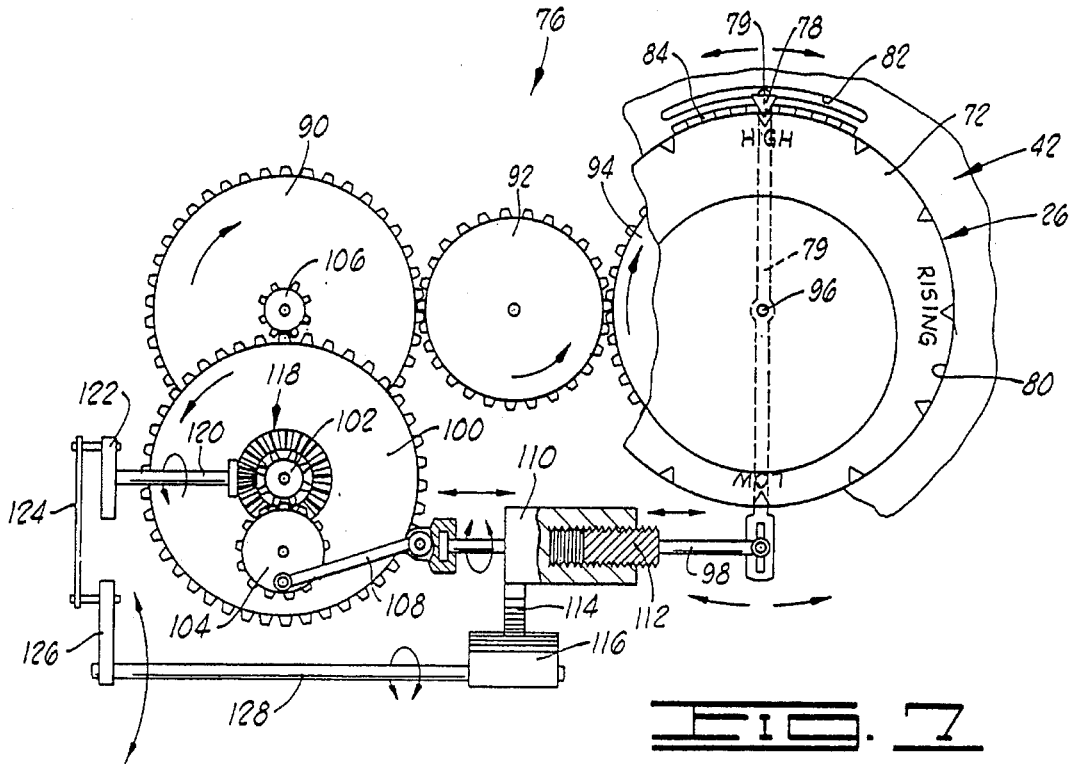
FIG. 7 is an enlarged partially cut away view illustrating one form of mechanical drive means for correcting the time intervals between high tides in accordance with the present invention.

Referring now to FIG. 7, one form of mechanical drive means 76 is illustrated which can be utilized to move the tide disk 72 and marker 78 as described above. The drive means 76 includes a primary drive gear 90 which can be operated by the time clock drive means motor or by a separate spring or electric motor. The gear 90 rotates clockwise at a rate of one revolution every 12 hours. An idler gear 92 which engages the drive gear 90 also engages a gear 94 which is fixedly connected to and rotates the tide disk 72 by means of a shaft 96 connected therebetween. The gear ratios between the gears 90, 92 and 94 are such that the tide disk drive gear 94 rotates at a rate of one revolution every 12 hours and 25.235 minutes. If the pointer 78 remained stationary, the tide disk would indicate a high tide every 12 hours and 25.235 minutes. However, the pointer 78 is reciprocated as described above. That is, the pointer 78 is attached to the arm member 79 and the vertical portion of the arm member 79 is pivoted about an axis which is coincident with the axis of the shaft 96. The vertical pivoted portion of the arm member 79 extends to a point below the tide disk 72, and the lower end thereof is pivotally attached to an arm member 98 which is reciprocated horizontally as will be described further below. The horizontal reciprocation of the arm member 98 pivots the vertical portion of the arm 79 about the axis coinciding with the shaft 96 which in turn causes the pointer 78 to be reciprocated in clockwise and counter clockwise directions between points to the left and right of the midpoint on the graduated scale 84.

The reciprocation of the arm member 98 is provided by a set of gears 100, 102 and 104 which are driven by a gear 106 attached to the shaft to which the gear 90 is attached. The gear ratios between the gears 100, 102, 104 and 106 are such that the gear 104 rotates at a rate of two revolutions per lunar month or once each 14.265 days. An arm member 108 is pivotally attached to the gear 104 at one end and to a rotatable internally threaded connecting member 110 at the other end. A non-rotatable externally threaded member 112 is threadedly engaged with the internally threaded connecting member 110. The non-rotatable threaded member 112 is connected to the arm member 98.

The connecting member 110 includes a sector gear 114 attached thereto which is engaged by an elongated complimentary sector gear 116, A bevel gear assembly 118 is attached to the gear 100 and to a rotatable shaft 120. The shaft 120 rotates a disk 122 connected thereto, and an arm member 124 is pivotally attached at one end thereof to the disk 122. The rotation of the disk 122 causes the arm member 124 to reciprocate, and the other end of the-arm member 124 pivotally attached to a lever arm 126. The lever arm is attached to a shaft 128 which is connected to the sector gear 116. The movement of the arm member 124 causes the lever arm 126 to be reciprocated which in turn causes the shaft 128 and sector gear 116 attached thereto to be rotatably reciprocated. The rotatable reciprocation of the sector gear 116 is transferred to the connecting member 110 by the sector gear 114 attached thereto. The rotational reciprocation of the connecting member 110 causes the threaded member 112 to be moved into and out of the threaded portion of the connector 110.

Thus, the rotation of the gear 104 causes the assembly (hereinafter referred to as the first assembly) comprised of the arm member 108, the threaded connecting member 110, the threaded member 112, the arm member 98 and the lower end of the arm member 79 connected to the pointer 78 to be reciprocated. The rotational reciprocation imparted to the connecting member 110 by the bevel gear assembly 118, the shaft 120, the disk 122, the arm member 124, the lever arm 126, the shaft 128 and the complimentary sector gears 114 and 116 (hereinafter referred to as the second assembly) has the effect of decreasing and increasing the overall length of the first assembly. Thus, the reciprocation of the arm member 79 by the first assembly causes the pointer 78 to move counterclockwise and clockwise from the position shown in FIG. 7 whereby the time between successive like tide states indicated by the tide state indicator 26 is cycled in a manner whereby the Solunar correction is applied. The additional variation in the movement of the pointer 78 caused by the second assembly, i.e., the horizontal movement of the threaded member 112 within the threaded connecting member 110, modifies the cycle in accordance with the Anomalistic correction.

Referring now to FIG. 4, a graph is presented showing an example of the corrections which can be applied to the time between successive like tide states by the first and second assemblies. That is, the correction produced by the first assembly can produce a monthly cycle like that indicated by the dashed line 10 in FIG. 4, and the correction produced by the second assembly can change the monthly cycle to that shown by the solid line 12 in FIG. 4. However, it is to be noted that FIG. 4 is presented as an example only, and is not intended to represent actual corrections or times.

As mentioned above, the phase relationship of the first and second harmonic corrections applied to the average time between like tide states must be periodically changed in order for the nautical clock of this invention to more accurately indicate the state of the tide. While the periodic changes can be made automatically or semi-automatically using a computer or the like, they are very easily and economically made manually based on instructions received from the clock manufacturer which are in turn based on historic tide data and predictions concerning the celestial perturbations to be experienced during the ensuing period. The phase changes can change the overall correction to the average time between like tide states during a lunar month from the cycle shown by the solid line 12 in FIG. 4 to a cycle of different period or a multiple thereof.

While particular means for manually changing the phase relationship of the harmonic corrections imparted by the first and second assemblies of the drive means 76 have not been illustrated, they involve changing the relative rotational position of the disk 122 with respect to the rotational position of the gear 104 and the lengthening or shortening of the horizontal movement provided to the arm member 79 by the first and second assemblies. Numerous conventional mechanical components and arrangements thereof for accomplishing such changes are well known and will suggest themselves to those skilled in the art. For example, the disk 122 can be connected to the shaft 120 by a friction device (not shown) which allows relative movement therebetween, and a knob and stem (not shown) which can be used to selectively engage the disk 122 can be provided for manually rotating the disk 122 to a selected position with respect to the position of the gear 104. A dial or other device for indicating the relative positions of the disk 122 and gear 104 can be provided.

The drive means 76 as illustrated in FIG. 7 and described above is intended to generally illustrate one form of drive means which can be utilized in accordance with the present invention. It will be understood by those skilled in the art that various other forms of drive means can be utilized to accomplish the same result. Further, it will be understood that additional conventional mechanism which is not shown in FIG. 7 will be included to facilitate the setting of the drive means 76 and for initially adjusting the degree of the reciprocation of the pointer 78 to provide the most accurate state of the tide indication by the indicator 26.

Figure 8:
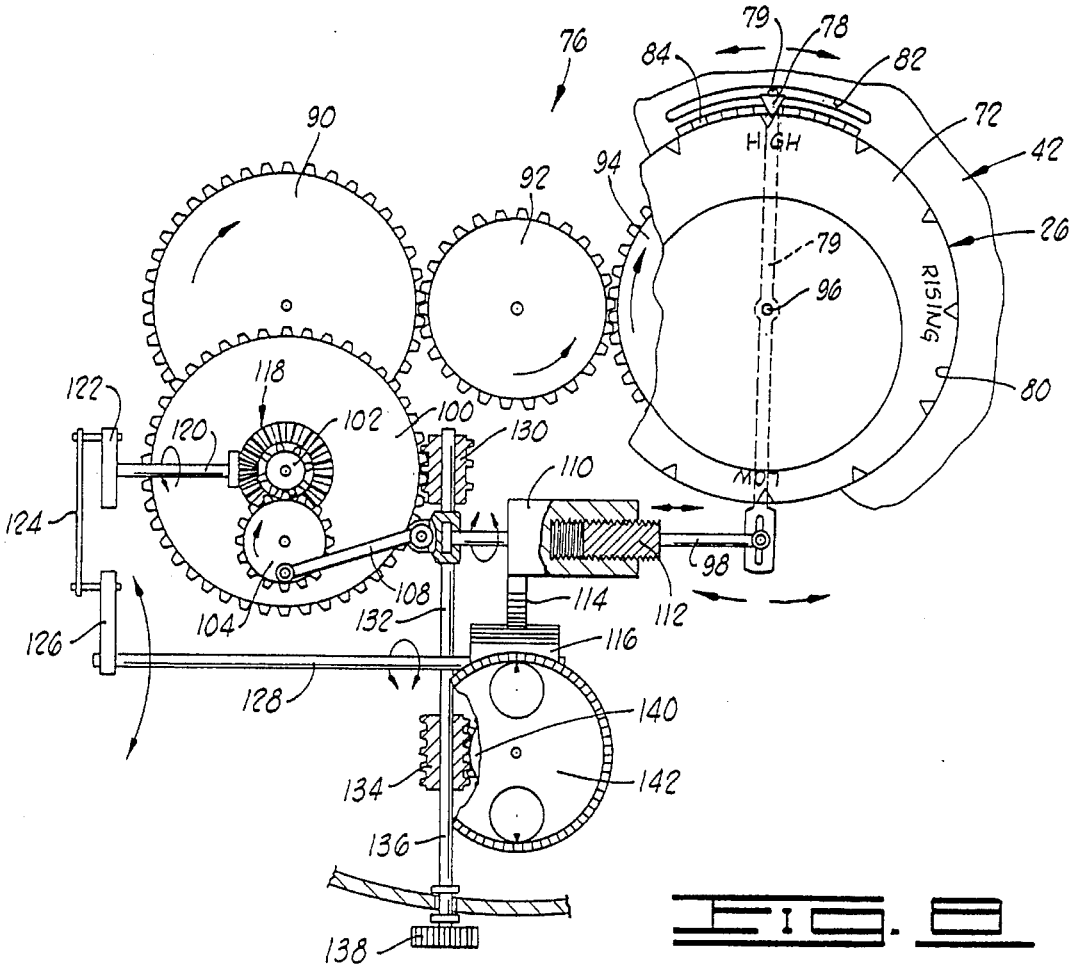
FIG. 8 is an enlarged partially sectional view similar to FIG. 7, but showing alternate means for correcting the time intervals between high tides.
Figure 8:
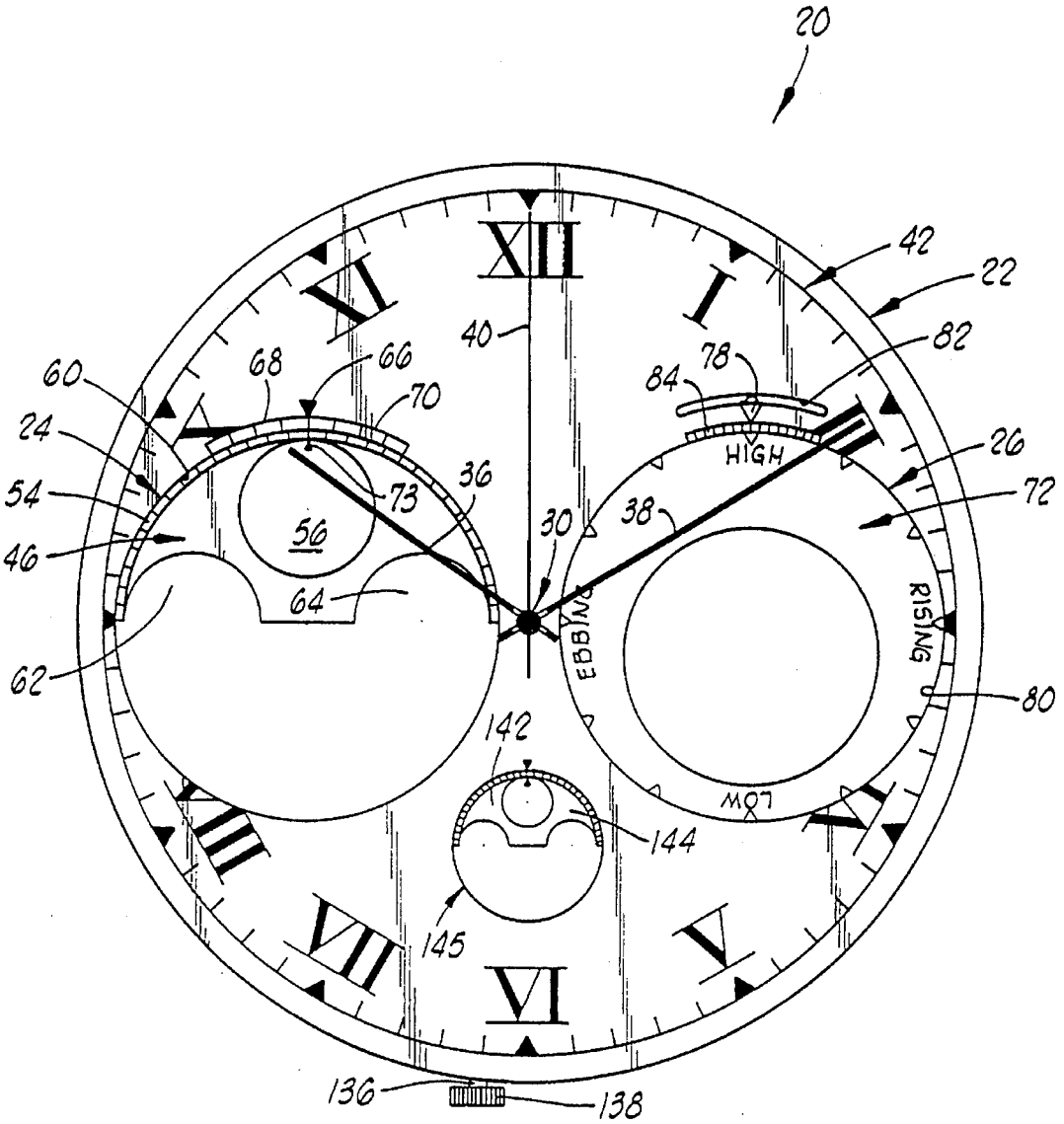

Instead of automatically moving the position of the marker 78 by the drive gear of the drive means 76, the position of the marker 78 can be adjusted manually by the apparatus illustrated in FIG. 8. That is, instead of the first and second assemblies being driven by the gear 106 connected to the primary drive gear 90 as shown in FIG. 7, the first and second assemblies are moved by the rotation of a worm gear 130 engaged with the gear 100 as shown in FIG. 8. The worm gear 130 is connected to a shaft 132, the other end of which is connected to a second worm gear 134. The worm gear 134 is connected to a stem 136 which extends to the exterior of the nautical clock 20 and has a manually rotatable knob 138 connected thereto. The worm gear 134 is engaged with a rotatable gear 140 which is connected to and rotates a second moon phase indicating disk 142. The moon disk 142 is generally identical to the moon disk 46 described above and functions in the same manner when rotated to indicate the phase of the moon.

As illustrated in FIG. 9, when the manually operable mechanism shown in FIG. 8 is used, an opening 144 is provided in the face 42 of the nautical clock 20 through which the moon disk 142 can be viewed thereby forming a moon phase indicator 145. A marker 146 is provided on the clock face 42 for indicating the moon phase and/or the number of days before or after a moon phase. When the knob 138 is rotated, the worm gears 130 and 134 are simultaneously also rotated which causes the gears 100 and 140 and the moon disk 142 to be rotated.

The gear ratios between the worm gears 130 and 134 and the gears 100 and 140 rotated thereby and the first and second assemblies of the drive means 76 described above are set whereby when the moon phase indicator 145 is manually set to match the moon phase indicator 24 of the nautical clock 22, the arm 79 and the marker 78 will be moved to introduce the proper combined Solunar and Anomalistic correction to the tide state indicator 26. As will be understood, in use of the drive mechanism illustrated in FIG. 8 the manual setting to match the moon phase indicator 145 with the moon phase indicator 24 must be made every day that the nautical clock 20 is used to indicate the tide state, and the periodic phase change between the Solunar and Anomalistic corrections also must be made.

Figure 10:
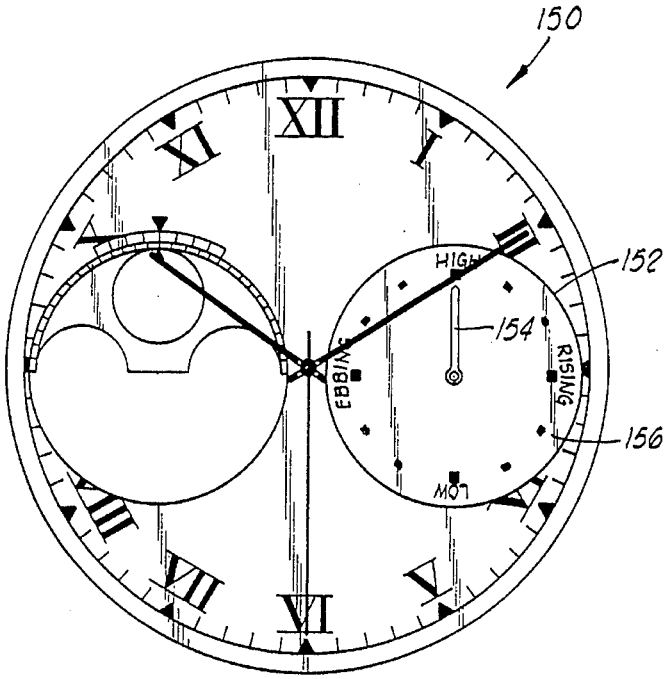
FIG. 10 is a front view of an alternate form of nautical clock apparatus of the present invention.
Figure 11:
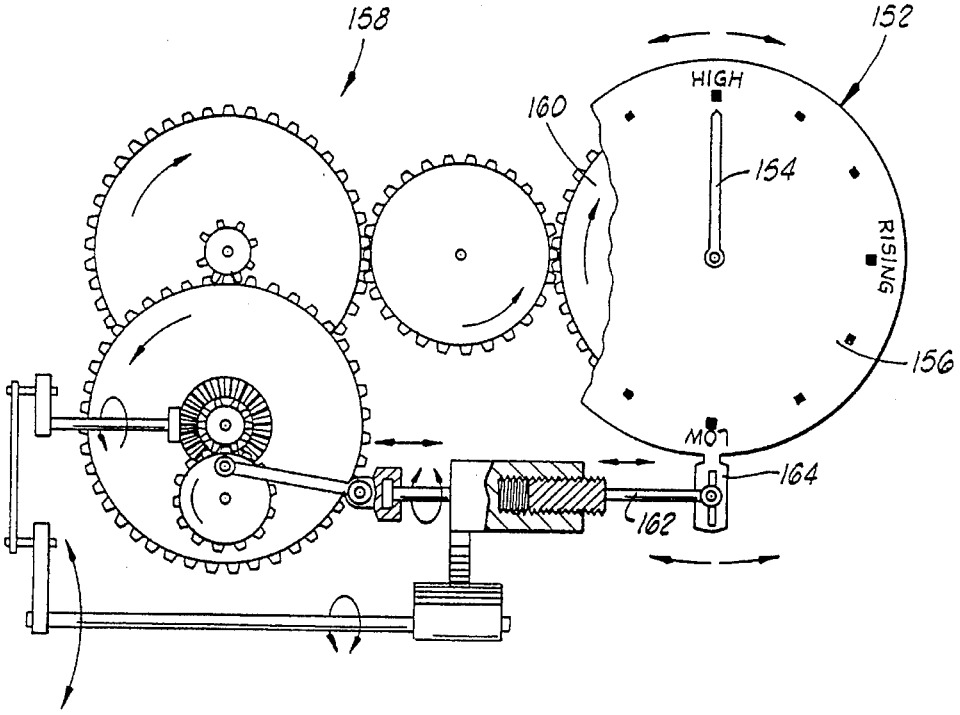
FIG. 11 is an enlarged partially sectional illustration of drive means for the clock apparatus of FIG. 9.

Referring now to FIG. 10, an alternate form of nautical clock 150 is illustrated. The nautical clock 150 is identical to the nautical clock 20 described above, except that a different form of tide state indicator 152 is included as a part of the clock 150. The tide state indicator 152 is the same as the tide state indicator 26 except that instead of the rotating tide disk 72, the tide state indicator 152 includes a rotatable pointer 154. In addition, instead of the marker 78, the tide state indicator 152 includes a movable disk 156 which has tide state markings on the face thereof. Thus, in the tide state indicator 152, the pointer 154 rotates at a rate of one revolution every 12 hours and 25.235 minutes and the movable disk 156 is reciprocated in the same way and for the same purpose as the marker 78 of the tide state indicator 26 described above. FIG. 10 illustrates a drive means 158 for automatically moving the disk 156 whereby it and the pointer 154 indicate the state of the tide. The drive means 158 is identical to the drive means 76 described above except that the pointer 154 is fixably connected to the gear 160 which rotates at a rate of one revolution every 12 hours and 25.235 minutes. The arm member 162 which reciprocates horizontally is pivotally connected to a connecting member 164 extending from the bottom of the disk 156.

Thus, in operation, the tide state indicator 152 of the nautical clock 150 indicates the state of the tide by rotating the pointer 154 at a rate of one revolution every 12 hours and 25.235 minutes and continuously reciprocating the rotatable disk 156 between a preselected high tide time which is longer than 12 hours and 25.235 minutes and a preselected high tide time which is shorter than 12 hours and 25.235 minutes, the reciprocation between the longer and shorter times occurring twice every lunar month.

In accordance with the methods of the present invention, the indication of tide state by a nautical clock is improved by basing the indication of high tide on a time between high tides of 12 hours and 25.235 minutes and a continuous correction to such time which lengthens and shortens such time on a cycle whereby it is longer during one or more portions of each lunar month and shorter during one or more other portions of each lunar month. More specifically, the time interval between high tides can increase from 12 hours and 25.235 minutes to a maximum longer time and then decreases to 12 hours and 25.235 minutes during certain portions of each lunar month, and the time between high tides can decrease from 12 hours and 25.235 minutes to a minimum shorter time and then increases back to 12 hours and 25.235 minutes during other portions of each lunar month.

Thus, the present invention is well adapted to carry out the objects and attain the ends and advantages mentioned as well as those which are inherent therein. While numerous changes to the nautical clock apparatus and the methods of this invention may be made by those skilled in the art, such changes are encompassed within the spirit of this invention as defined by the appended claims.

What is claimed is:

1. An improved nautical clock comprising:

a clock base;

a tide state indicator attached to said base;

first means attached to said tide state indicator and to said base for adjusting said tide state indicator to cause said tide state indicator to continuously indicate a time between successive like tide states based on a set time interval therebetween of about 12 hours and 25.235 minutes; and second means attached to said tide state indicator and to said base for further adjusting said tide state indicator to cause said tide state indicator to continuously indicate a time between successive like tide states that varies on a cycle such that said time is longer than about 12 hours and 25.235 minutes during at least one portion of each lunar month and shorter than about 12 hours and 25.235 minutes during at least one other portion of each lunar month.

2. The nautical clock of claim 1 wherein said second means further adjusts said tide state indicator to cause said tide state indicator to continuously indicate a time between successive like tide states that varies on a cycle such that said time increases from about 12 hours and 25.235 minutes to a maximum longer time and then decreases to about 12 hours and 25.235 minutes during at least one portion of each lunar month, and decreases from about 12 hours and 25.235 minutes to a minimum shorter time and then increases to about 12 hours and 25.235 minutes during at least one other portion of each lunar month.

3. The nautical clock of claim 1 wherein said tide state indicator, said first means for adjusting said tide state indicator and said second means for further adjusting said tide state indicator are at least partially mechanical.

4. The nautical clock of claim 1 which is further characterized to include time clock means for continuously indicating the time of day attached to said clock base.

5. The nautical clock of claim 1 which is further characterized to include moon phase indicating means for continuously indicating the phase of the moon attached to said clock base.

6. In a method of indicating the tide state with a nautical clock having a clock base and a tide state indicator attached to the base that includes the steps of indicating the tide state with the tide state indicator and adjusting the tide state indicator to cause it to continuously indicate the tide state based on a set time interval between successive like tide states of about 12 hours and 25.235 minutes, the improvement comprising further adjusting said tide state indicator to continuously correct the continuous indication of the tide state provided thereby such that said indication is based on: (a) said time interval between successive like tide states of about 12 hours and 25.235 minutes, and (b) a continuous correction to said time interval which lengthens and shortens said time interval on a cycle such that said time interval is longer than about 12 hours and 25.235 minutes during at least one portion of each lunar month and shorter than about 12 hours and 25.235 minutes during at least one other portion of each lunar month.

7. The method of claim 6 wherein said continuous correction to said time interval on which said continuous indication of the tide state provided by said tide state indicator is based lengthens and shortens said time interval on a cycle whereby said time interval increases from about 12 hours and 25.235 minutes to a maximum longer time and then decreases to about 12 hours and 25.235 minutes during certain portions of each lunar month, and then decreases from about 12 hours and 25.235 minutes to a minimum shorter time and then increases to about 12 hours and 25.235 minutes during other portions of each lunar month.

8. In a nautical clock of the type including a clock base, a tide state indicator attached to the base and means connected to the tide state indicator for causing the tide state indicator to continuously indicate the tide state,in response to a time interval between successive like tide state of about 12 hours and 25.235 minutes, the improvement comprising additional means connected to said tide state indicator for causing said tide state indicator to continuously indicate the tide state in response to both said time interval between successive like tide states of about 12 hours and 25.235 minutes and a continuous correction to said time interval which lengthens and shortens said time interval on a cycle whereby said time interval is longer than about 12 hours and 25.235 minutes during at least one portion of each lunar month and shorter than about 12 hours and 25.235 minutes during at least one other portion of each lunar month.

9. The nautical clock of claim 8 wherein said continuous correction to said time interval lengthens and shortens said time interval on a cycle whereby said time interval increases from about 12 hours and 25.235 minutes to a maximum longer time and then decreases to about 12 hours and 25.235 minutes during certain portions of each lunar month, and said time interval decreases from about 12 hours and 25.235 minutes to a minimum shorter time and then increases to about 12 hours and 25.235 minutes during other portions of each lunar month.

* * * * *